US005455132A

United States Patent [19]

Ritt et al.

[11] Patent Number: 5,455,132

[45] Date of Patent: Oct. 3, 1995

[54] METHOD OF ELECTROPHOTOGRAPHIC PHOSPHOR DEPOSITION

[75] Inventors: Peter M. Ritt, E. Petersburg; Owen H. Roberts, Jr., Landisville; Robert E. Kreider, Lancaster, all of Pa.

[73] Assignee: Thomson Consumer Electronics, Inc., Indianapolis, Ind.

[21] Appl. No.: 250,231

[22] Filed: May 27, 1994

[51] Int. Cl.[6] ..... G03C 5/00

[52] U.S. Cl. ..... 430/23; 430/28; 430/29

[58] Field of Search ..... 430/23, 28, 29

[56] References Cited

U.S. PATENT DOCUMENTS

| | | | |
|---|---|---|---|
| 3,558,310 | 1/1971 | Mayaud | 96/36.1 |
| 4,917,978 | 4/1990 | Ritt et al. | 430/23 |
| 4,921,767 | 5/1990 | Datta et al. | 427/57 |
| 5,083,959 | 1/1992 | Datta et al. | 445/52 |

*Primary Examiner*—S. Rosasco

*Attorney, Agent, or Firm*—Joseph S. Tripoli; Dennis H. Irlbeck; Vincent J. Coughlin, Jr.

[57] ABSTRACT

In accordance with the present invention, a method of electrophotographically manufacturing a luminescent screen assembly on a photoreceptor disposed on an interior surface of a faceplate panel for a color CRT includes the steps of: charging the photoreceptor to establish a substantially uniform electrostatic voltage thereon; positioning the panel on an exposure device having a light source therein; exposing selected areas of the photoreceptor to visible light from the light source to affect the voltage thereon, without affecting the voltage on the unexposed area of the photoreceptor; and depositing a triboelectrically charged, first color-emitting phosphor onto the selected areas of the photoreceptor. The charging, positioning, exposing and depositing steps are repeated for a second and a third triboelectrically charged, color-emitting phosphor. The present method is an improvement over prior methods because after each of the phosphor deposition and panel recharging steps, the light source is offset in the exposure device by an amount determined by the voltage difference between the photoreceptor and the phosphor, or phosphors, previously deposited onto the panel, thereby counteracting the repulsive effect of the previously deposited phosphor and minimizing the misregister of subsequently deposited phosphors.

5 Claims, 3 Drawing Sheets

Fig. 1
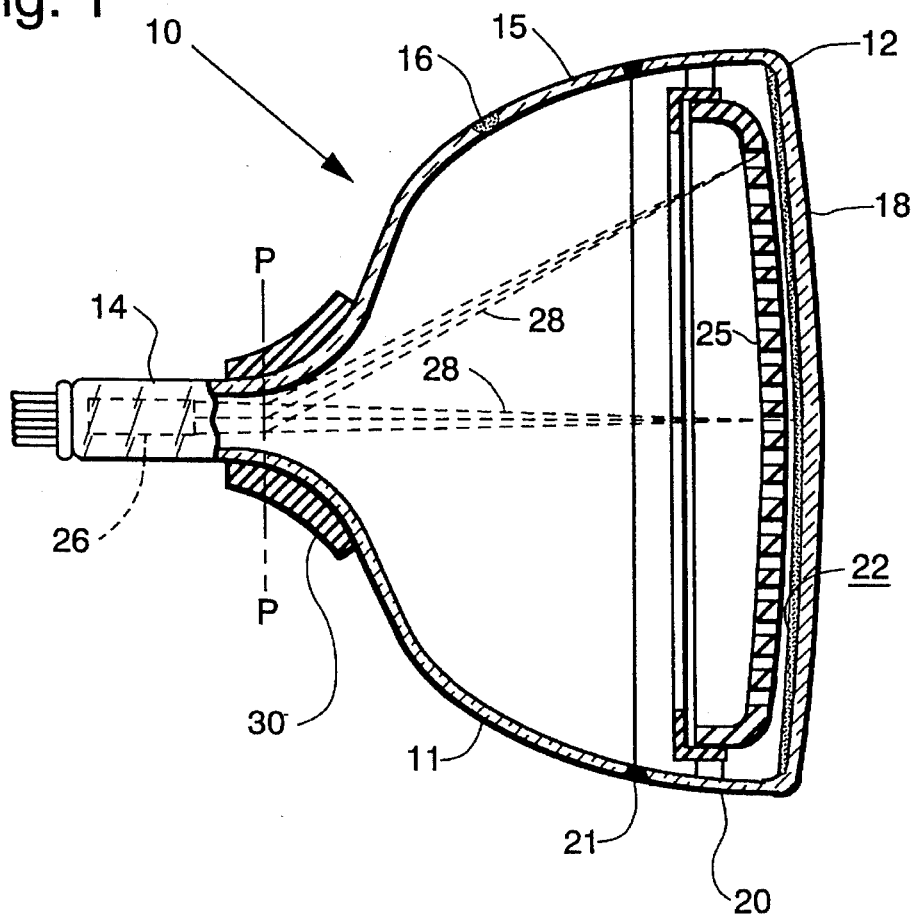
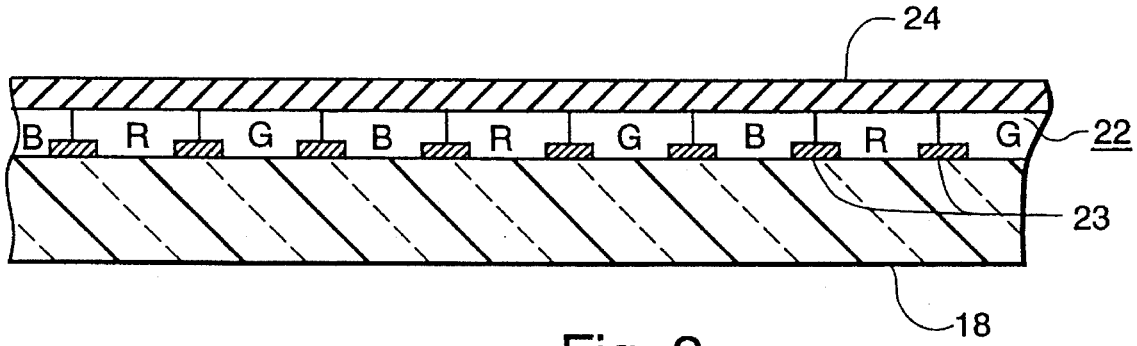
Fig. 2

METHOD OF ELECTROPHOTOGRAPHIC PHOSPHOR DEPOSITION

The present invention relates to a method of electrophotographically manufacturing a luminescent screen assembly for a cathode-ray tube (CRT) using triboelectrically charged phosphors, and more particularly, to a method that minimizes the misregister of the subsequently deposited phosphors, caused by the charging properties of the previously deposited phosphors.

In the manufacturing of a luminescent screen by the conventional wet slurry process, the phosphors are deposited in the sequence: green, blue and red. This same phosphor deposition sequence is utilized in the electrophotographic screening (EPS) process described in U.S. Pat. No. 4,921, 767, issued to Datta et al., on May 1, 1990.

In the EPS process described in the above-referenced patent, dry-powdered, triboelectrically charged, color-emitting phosphors are deposited on a suitably prepared, electrostatically chargeable photoreceptor. The photoreceptor comprises an organic photoconductive (OPC) layer overlying, preferably, an organic conductive (OC) layer, both of which are deposited, serially, on an interior surface of a CRT faceplate panel. Initially, the OPC layer of the photoreceptor is electrostatically charged to a positive voltage using a suitable corona discharge apparatus. Then, selected areas of the photoreceptor are exposed to visible light to discharge those areas without affecting the charge on the unexposed areas. Next, triboelectrically positively charged, green-emitting phosphor is deposited, by reversal development, onto the discharged areas of the photoreceptor, to form phosphor lines of substantially uniform width and screen weight. The photoreceptor and the green-emitting phosphor are recharged by the corona discharged apparatus to impart an electrostatic charge thereon. It is desirable that the charge on the photoreceptor be of the same magnitude as the charge on the previously deposited green-emitting phosphor; however, it has been determined that the photoreceptor and the previously deposited phosphor do not necessarily charge to the same voltage. In fact, the charge acceptance of the phosphors is different from the charge acceptance of the photoreceptor. Consequently, when different selected areas of the photoreceptor are exposed to visible light to discharge those areas to facilitate reversal development thereof with triboelectrically positively charged blue-emitting phosphor, the previously deposited green-emitting phosphor retains a positive charge of a different magnitude than the positive charge on the unexposed portion of the photoreceptor. This charge difference influences the deposition of the positively charged blue-emitting phosphor, causing it to be more strongly repelled by the charge on the previously deposited green-emitting phosphor, than by the charge retained on the unexposed areas of the photoreceptor. This stronger repelling effect of the green-emitting phosphor causes the blue-emitting phosphor to be slightly displaced from its desired location on the photoreceptor. The repelling effect of the prior deposited phosphor is small, nevertheless, the width of the blue-emitting phosphor lines is narrower than desired. The photoreceptor and the green- and blue-emitting phosphors are recharged by the corona discharge apparatus to impart a positive electrostatic charge thereon to facilitate the deposition of the red-emitting phosphor. The photoreceptor as well as the green-, and the blue-emitting phosphors have a positive charge of a different magnitude thereon. Selected areas of the photoreceptor are discharged by exposure to light, while the charge on the unexposed areas of the photoreceptor and on the prior deposited phosphor is unaffected. The triboelectrically positively charged red-emitting phosphor is more strongly repelled by one of the prior deposited phosphors than by the other, in this instance the green-emitting phosphor, causing misregister of the red phosphor as it is deposited onto the discharged areas of the photoreceptor. Again, the effect is small; however, the red phosphor is slightly displaced from its desired location on the photoreceptor, resulting in a narrowing of the red phosphor lines.

In order to manufacture a screen by the EPS process without the above described misregister, it is necessary that compensation for the repulsive effect of the previously deposited, electrostatically-charged phosphors be provided.

SUMMARY OF THE INVENTION

In accordance with the present invention, a method of electrophotographically manufacturing a luminescent screen assembly on a photoreceptor disposed on an interior surface of a faceplate panel for a color CRT includes the steps of: charging said photoreceptor to establish a substantially uniform electrostatic voltage thereon; positioning the panel on an exposure device having a light source therein; exposing selected areas of the photoreceptor to visible light from said light source to affect the voltage on the exposed, selected areas without affecting the voltage on the unexposed area of the photoreceptor; and depositing a triboelectrically charged, first color-emitting phosphor onto the selected areas of the photoreceptor. The charging, positioning, exposing and depositing steps are repeated for a second and a third triboelectrically charged, color-emitting phosphor. The present method is an improvement over prior methods because after each of the phosphor deposition and panel recharging steps, the light source in the exposure device is offset by an amount determined by the voltage difference between the photoreceptor and the phosphor, or phosphors, previously deposited onto the panel, thereby counteracting the repulsive effect of the previously deposited phosphor and minimizing the misregister of subsequently deposited phosphors.

BRIEF DESCRIPTION OF THE DRAWINGS

The invention will now be described in greater detail, with relation to the accompanying drawings, in which:

FIG. 1 is a plan view, partially in axial section, of a color CRT made according to the present invention.

FIG. 2 is a section of a faceplate panel of the CRT of FIG. 1 showing a screen assembly.

DETAILED DESCRIPTION OF THE PREFERRED EMBODIMENT

Figure 3:
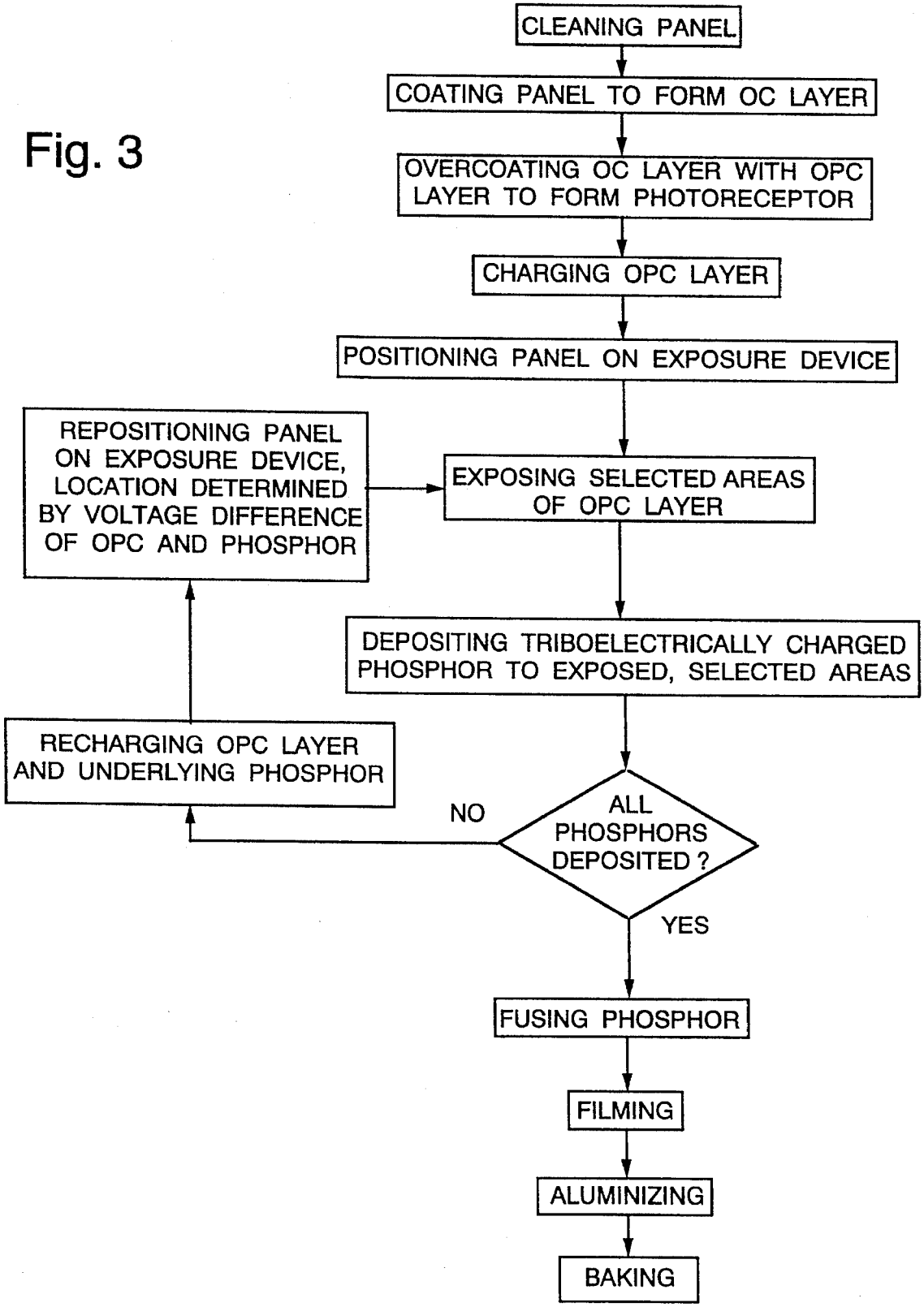
FIG. 3 is a diagram of the novel manufacturing process for the screen assembly.
Figure 4A:
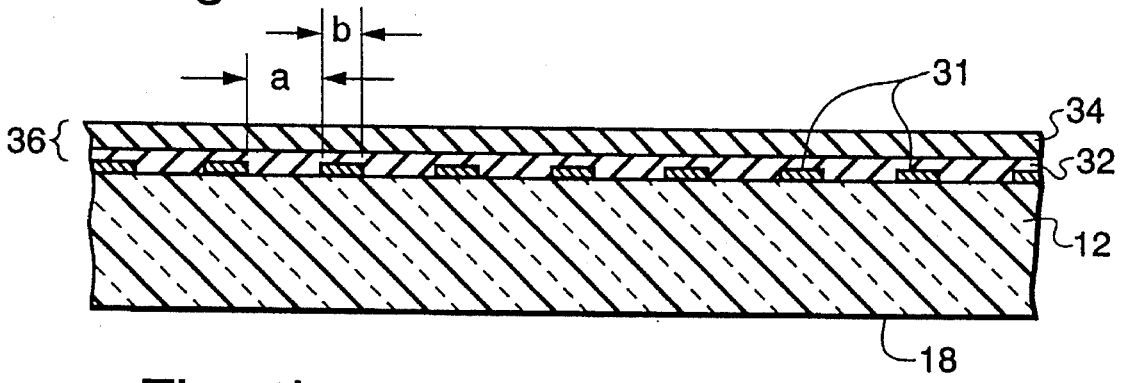
FIG. 4*a*–4*d* shows selected steps in the novel manufacturing process for the screen assembly of the CRT of FIG. 1.
Figure 4B:
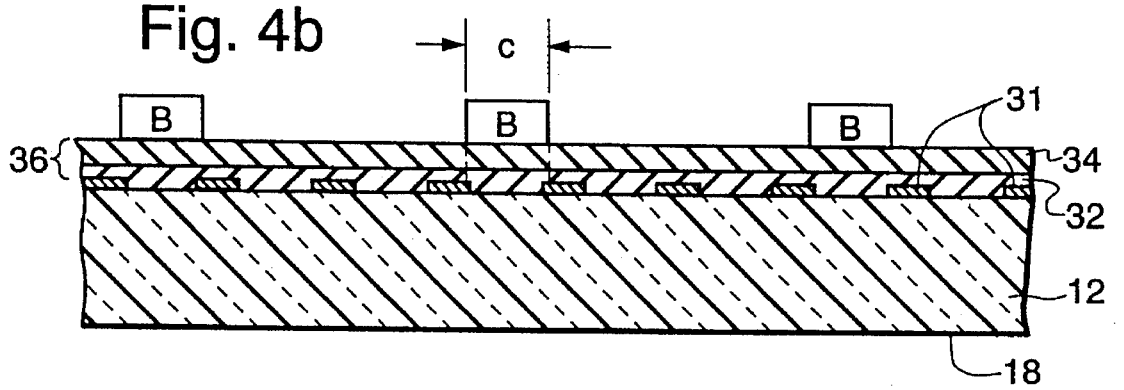
Figure 4C:
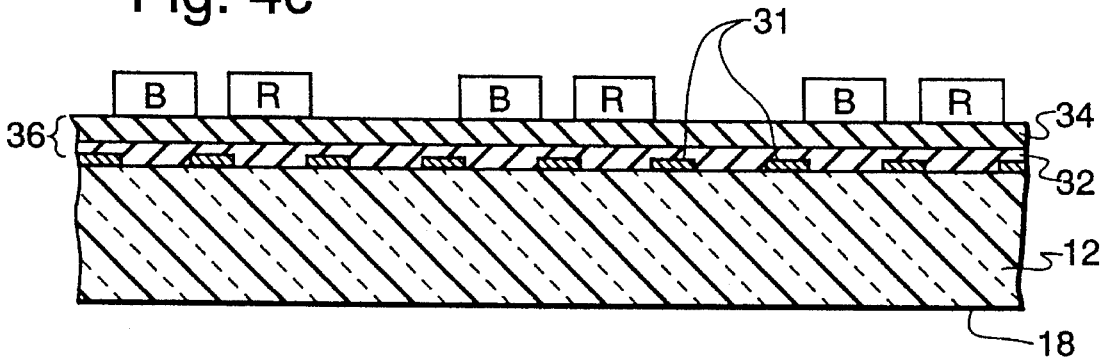
Figure 4D:
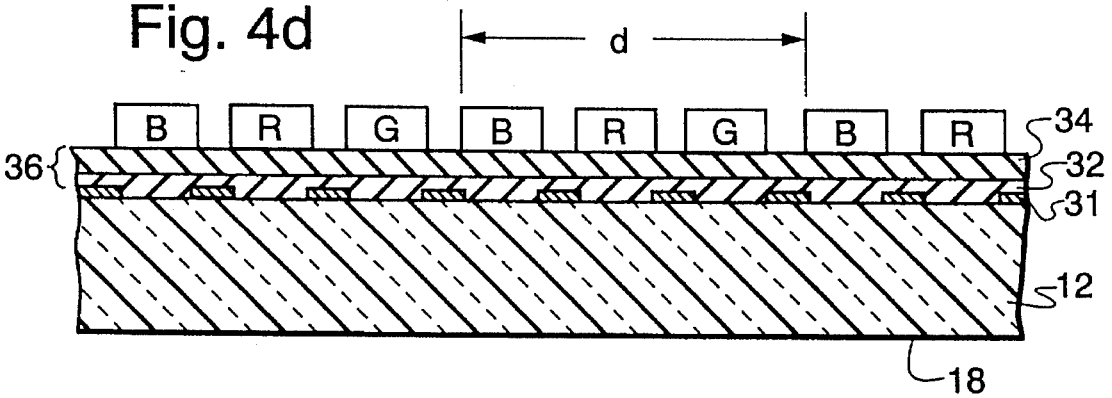

FIG. 1 shows a color CRT 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate or substrate 18 and a peripheral flange or sidewall 20, which is sealed to the funnel 15 by a glass frit 21. A three color phosphor screen 22 is carried on the inner surface of the faceplate 18. The screen 22, shown in FIG. 2, is a line screen which includes a multiplicity of screen elements comprised of red-emitting, green-emitting and blue-emitting phosphor stripes R, G, and B, respectively, arranged in color groups or picture elements of three stripes or triads, in a cyclic order. The stripes extend in a direction which is generally normal to the plane in which the electron beams are generated. In the normal viewing position of the embodiment, the phosphor stripes extend in the vertical direction. Preferably, at least portions of the phosphor stripes overlap a relatively thin, light absorptive matrix 23, as is known in the art. Alternatively, the matrix can be formed after the screen elements are deposited. A dot screen also may be formed by the novel process. A thin conductive layer 24, preferably of aluminum, overlies the screen 22 and provides means for applying a uniform potential to the screen, as well as for reflecting light, emitted from the phosphor elements, through the faceplate 18. The screen 22 and the overlying aluminum layer 24 comprise a screen assembly. A multi-apertured color selection electrode or shadow mask 25 is removably mounted, by conventional means, in predetermined spaced relation to the screen assembly.

An electron gun 26, shown schematically by the dashed lines in FIG. 1, is centrally mounted within the neck 14, to generate and direct three electron beams 28 along convergent paths, through the apertures in the mask 25, to the screen 22. The electron gun is conventional and may be any suitable gun known in the art. The center-to-center spacing between adjacent electron beams within the electron gun ranges from about 4.1 to 6.6 mm, depending on gun type and tube size.

The tube 10 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically, in a rectangular raster, over the screen 22. The initial plane of deflection (at zero deflection) is shown by the line P—P in FIG. 1, at about the middle of the yoke 30. For simplicity, the actual curvatures of the deflection beam paths, in the deflection zone, are not shown.

The screen is manufactured by an electrophotographic process that is shown in FIGS. 3 and 4. Initially, the panel 12 is cleaned by washing it with a caustic solution, rinsing it in water, etching it with buffered hydrofluoric acid and rinsing it again with water, as is known in the art. The interior surface of the viewing faceplate 18 is then provided with a light absorbing matrix 31, preferably, using the conventional wet matrix process described in U.S. Pat. No. 3,558,310, issued to Mayaud on Jan. 26, 1971. In the wet matrix process, a suitable photoresist solution is applied to the interior surface, e.g., by spin coating, and the solution is dried to form a photoresist layer. Then, the shadow mask is inserted into the faceplate panel and the panel is placed onto a three-in-one lighthouse which exposes the photoresist layer to actinic radiation from a light source which projects light through the openings in the shadow mask. The exposure is repeated two more times with the light source located to simulate the paths of the electron beams from the three electron guns. The light selectively alters the solubility of the exposed areas of the photoresist layer where phosphor materials will subsequently be deposited. After the third exposure, the panel is removed from the light house and the shadow mask is removed from the panel. The photoresist layer is developed to remove the more soluble areas of the photoresist layer, thereby exposing the underlying interior surface of the faceplate and leaving the less soluble, exposed areas intact. Then, a suitable solution of light absorbing material is uniformly provided onto the interior surface of the faceplate to cover the exposed portion of the faceplate and the retained, less soluble, areas of the photoresist layer. The layer of light absorbing material is dried and developed using a suitable solution which will dissolve and remove the retained portion of the photoresist layer and the overlying light absorbing material, forming windows in the matrix layer which is adhered to the interior surface of the faceplate. For a faceplate panel 18 having a diagonal dimension of 51 cm (20 inches) the window openings formed in the matrix and shown in FIG. 4*a*, have a width, a, of about 0.13 to 0.18 mm, and the matrix lines have a width, b, of about 0.1 to 0.15 mm. The interior surface of the faceplate panel, having the matrix 31 thereon, is then coated with a suitable layer 32 of a volatilizable organic conductive (OC) material which provides an electrode for an overlying volatilizable organic photoconductive (OPC) layer 34. The OC layer 32 and the OPC layer 34 are shown in FIG. 5*a* and, in combination, comprise a photoreceptor 36.

The phosphor elements of the screen are formed by serially depositing triboelectrically charged phosphor particles onto the suitable charged OPC layer 34 of the photoreceptor 36. To overcome the above-described misregister problem, the surface-charging properties of the phosphors were investigated. In the EPS process, the prior deposited phosphors must be corona charged for subsequent second and third phosphor depositions. The prior EPS practice of depositing the green-emitting phosphors first, followed by the blue- and then the red-emitting phosphors causes a misregister of the second and third subsequently deposited phosphors. It is believed that the prior deposited phosphors acquire an electrostatic charge, during corona charging of the photoreceptor, that is different from the charge on the photoreceptor itself. If this were not so, then each of the three phosphor depositions would be identical and no misregister would occur. It has been determined that each of the color-emitting phosphors, after deposition onto the photoreceptor, charges to a voltage different from one another and different from the voltage on the photoreceptor, leading to the conclusion that the phosphor surface-charging characteristics are related to the material properties of the phosphor and the amount of phosphor deposited. To test this hypothesis, an estimate of a surface charging characteristic called "layer voltage" was made for each of the phosphor materials. Layer voltage is defined as the difference between voltage measurements made on the OPC layer 34 immediately before deposition of the phosphor and immediately afterward. The effect that the amount of phosphor material has on the layer voltage can be determined by depositing a solid field, i.e., only one color of phosphor onto the photoreceptor. The voltage on the OPC layer 34 of the photoreceptor 36 on the panel is measured before and after phosphor deposition and the quantity of phosphor deposited onto the OPC layer is weighed to determine the layer voltage per mg. per square cm. of phosphor. The layer voltage is determined for each of the color-emitting phosphors. The blue-emitting phosphor comprises core material coated with silica having an overcoating of acrylic latex thereon to adhere the $CoAl_2O_4$ blue pigment. The red-emitting phosphor comprises core material coated with acrylic latex which adheres the $Fe_3O_4$ red pigment. The green-emitting phosphor is not pigmented, but is coated with silica and acrylic latex. The layer voltages are summarized in TABLE 1.

TABLE 1

| Color | Layer Voltage (V/mg/cm$^2$) |
|---|---|
| Red | 20 |
| Blue | 29 |
| Green | 56 |

From TABLE 1 it can be concluded that because the green-emitting phosphor has the highest layer voltage it also has the greatest effect on misregister. Red-emitting phosphor, on the other hand, has the lowest layer voltage and is the most susceptible to alignment variations. Blue-emitting phosphor has a layer voltage in between the other two phosphor, but provides the best properties for EPS deposition because its corona charging property most closely matches that of the photoconductor layer. Blue-emitting phosphor is therefore the best choice for the first color deposition.

Using the layer voltage information, listed above, a series of tests were conducted using the six possible phosphor deposition sequences. It is believed that merely changing the deposition sequence from G, B, R of the prior art will not eliminate the misregister problem, because each subsequently deposited phosphor will be influenced by the previously deposited phosphor and also will have some effect on the later deposited phosphors. Thus, a lateral shift of the area of illumination on the OPC layer 34 of the photoreceptor 36 for each subsequent phosphor deposition is required to counteract the repulsive effect of the prior phosphor deposition. In other words, the light location within the lighthouse must be laterally offset from the standard lighthouse setting to counteract the repulsive effect of the prior phosphor. The amount of lateral offset for the second phosphor is listed in TABLE 2. The lateral offset is expressed as a shift of the light image on the OPC layer in the "X" direction, i.e., toward the first color deposited onto the photoreceptor.

TABLE 2

| First Color | "X" offset of second phosphor | Layer Voltage |
|---|---|---|
| Green | 0.711 mm (0.028 in) | 56 V/mg/cm$^2$ |
| Red | 0.127 mm (0.005 in) | 20 V/mg/cm$^2$ |
| Blue | 0.381 mm (0.015 in) | 29 V/mg/cm$^2$ |

As stated above, in both the wet slurry and the prior EPS processes for depositing screen phosphors, green-emitting phosphor is the first phosphor deposited. Because in the wet slurry process there is no electrostatic charge on the faceplate surface, the location of the light in the lighthouse does not require any lateral offset, unless such an offset is necessary to compensate for misregister of the lighthouse caused, for example, by thermal effects on the panel/mask assembly, or the like. In the prior processes, the lighthouse lamp positions for the red- and blue-emitting phosphors are set an equal distance on either side of the green setting to simulate the spacing between the electron beams from the red- and blue-impinging electron guns relative to the green-impinging gun. For a 51 cm faceplate, the standard lighthouse settings, assuming no compensation, are G (green)=0; B(blue)=–4.064 mm; and R(red)=+4.064 mm. However, in the lighthouse used in the following test, a compensation of +0.254 mm (0.010 in) is required. Therefore, the (corrected) standard settings, taking into account the lighthouse compensation, are G=+0.254 mm; B=–3.81 mm; and R=+4.318 mm.

Using the corrected standard lighthouse settings, three faceplate panels were screened by the EPS process for each of the six possible phosphor deposition sequences, and the misregister of the phosphor lines was measured at eleven locations on the screen: in the center (C), in each corner (2D, 4D, 8D and 10D), at the ends of the major and minor axes (3, 9 and 6, 12 o'clock, respectively) and at the midpoints of the major axes right and left of center (3M and 9M, respectively). Three panels for each phosphor deposition sequence were measured for misregister and the readings were averaged for each color, at each location. Misregister of a phosphor line is defined as a line displaced by +/–0.023 mm (0.0009 in), or more, from its intended location. Three additional panels were screened by the EPS method to obtain the minimum misregister of the phosphor lines by adjusting the lateral position of the lamp within the lighthouse. Because changes were made in the lamp location for the screening of the last three panels in each phosphor deposition sequence, only the best panel of the three is reported for optimized alignment. The test results are summarized in TABLE 3

TABLE 3

| Panel Misregister Summary | | |
|---|---|---|
| Phosphor Sequence | Standard Alignment (Number of Misregistered Locations) | Optimized Alignment (Number of Misregistered Locations) |
| G - B - R | 9 | 9 |
| G - R - B | 16 | 11 |
| B - G - R | 20 | 3 |
| B - R - G | 4 | 4 |
| R - B - G | 21 | 6 |
| R - G - B | 9 | 8 |
| Total | 79 | 41 |

Surprisingly, not all of the misregister occurred on the second and third deposited phosphors, as might be expected if misregister was caused only by the electrostatic repulsion of subsequently deposited phosphors by previously deposited phosphors, having an electrostatic charge thereon that is different from the charge on the photoreceptor 36. The cause of the first deposition misregister is unknown. The misregister by color deposition for panels screened using both the standard lighthouse setting and an optimized lighthouse setting for each phosphor location on the panel is listed in TABLE 4. From TABLE 4, it is evident that the panel location having the greatest incidence of first deposition misregister changed from the 8D location, for the standard lighthouse setting, to the 3 o'clock location, for the optimized lighthouse setting.

TABLE 4

| PANEL MISREGISTER | | | | | | | | |
|---|---|---|---|---|---|---|---|---|
| | NUMBER OF MISREGISTERED LOCATIONS | | | | | | | |
| COLOR | STANDARD SETTING | | | | OPTIMIZED SETTING | | | |
| DE-POSITED: | 1st | 2nd | 3rd | TO-TAL | 1st | 2nd | 3rd | TO-TAL |
| Panel Location | | | | | | | | |
| C | 0 | 3 | 2 | 5 | 0 | 1 | 0 | 1 |
| 2D | 0 | 0 | 0 | 0 | 0 | 1 | 4 | 5 |

TABLE 4-continued

| COLOR DEPOSITED: | PANEL MISREGISTER NUMBER OF MISREGISTERED LOCATIONS STANDARD SETTING 1st | 2nd | 3rd | TOTAL | OPTIMIZED SETTING 1st | 2nd | 3rd | TOTAL |
|---|---|---|---|---|---|---|---|---|
| 4D | 3 | 3 | 5 | 11 | 0 | 0 | 1 | 1 |
| 8D | 6 | 3 | 5 | 14 | 1 | 1 | 0 | 2 |
| 10D | 1 | 3 | 2 | 6 | 0 | 1 | 2 | 3 |
| 3 o'clock | 5 | 5 | 5 | 15 | 4 | 3 | 3 | 10 |
| 9 o'clock | 0 | 2 | 0 | 2 | 2 | 5 | 5 | 12 |
| 6 o'clock | 1 | 3 | 2 | 6 | 0 | 1 | 0 | 1 |
| 12 o'clock | 0 | 2 | 1 | 3 | 0 | 0 | 1 | 1 |
| 3M | 5 | 4 | 4 | 13 | 1 | 1 | 1 | 3 |
| 9M | 0 | 3 | 1 | 4 | 1 | 1 | 0 | 2 |
| TOTAL | 21 | 31 | 27 | 79 | 9 | 15 | 17 | 41 |

The number of misregister defects by phosphor color is listed in TABLE 5.

TABLE 5

| PHOSPHOR COLOR: | PANEL MISREGISTER NUMBER OF MISREGISTERED LOCATIONS STANDARD SETTING 1st | 2nd | 3rd | TOTAL | OPTIMIZED SETTING 1st | 2nd | 3rd | TOTAL |
|---|---|---|---|---|---|---|---|---|
| Green | 8 | 10 | 9 | 27 | 5 | 2 | 6 | 13 |
| Red | 9 | 9 | 11 | 29 | 4 | 6 | 5 | 15 |
| Blue | 4 | 12 | 7 | 23 | 0 | 7 | 6 | 13 |
| Total | 21 | 31 | 27 | 79 | 9 | 15 | 17 | 41 |

Each of the panels screened in this test are processed as shown in FIGS. 3 and 4. Initially, the panel 12 is cleaned and a matrix 31 is provided on the interior surface of the faceplate 18. As shown in FIG. 4*a*, the OC layer 32 is deposited over the matrix 31 and the OPC layer 34 is formed over the OC layer to form the photoreceptor 36. Suitable materials for the OC layer 32 and for the OPC layer 34 are described in co-pending U.S. patent application Ser. Nos. 168,485 and 168,486 respectively, filed on Dec. 22, 1993 by Datta et al. The photoreceptor is uniformly electrostatically charged using a suitable corona discharge device which charges the photoreceptor to a voltage within the range of +200 to +700 volts. A suitable charging device is described in U.S. Pat. No. 5,083,959, issued to Datta et al on Jan. 28, 1992. The shadow mask 25 is then inserted into the panel 12 and the positively charged photoreceptor 36 is exposed, through the shadow mask 25, to visible light from a xenon flash lamp, or other light source of sufficient intensity, such as a mercury arc, disposed within the lighthouse (not shown). The position of the lamp within the lighthouse for all corrected standard positions is described above. The light which passes through the apertures in the shadow mask 25 creates a charge image by discharging the illuminated areas on the photoreceptor 36 on which it is incident without discharging the non-illuminated area. The shadow mask is removed from the panel 12 and the panel is placed onto a first phosphor developer (also not shown). The first color-emitting phosphor material is positively triboelectrical charged within the developer and directed toward the photoreceptor 36. The positively charged first color-emitting phosphor material is repelled by the positively charged areas on the photoreceptor 36 and deposited onto the discharged areas thereof by the process known in the art as "reversal" development. Reversal development and a suitable developer are described in copending U.S. patent application Ser. No. 132,263, filed on Oct. 6, 1993 by Riddle et al. and assigned to the assignee of the present invention. Briefly, in reversal development, triboelectrically charged particles of screen structure material are repelled by similarly charged areas of the photoreceptor and deposited onto the discharged areas of the photoreceptor. The location of the first color-emitting phosphor, e.g., blue, is shown in FIG. 4*b*. The phosphor lines have a width c of about 0.15 to 0.27 mm and slightly overlap the matrix 31 on either side of the line. The panel 12 is then recharged using the above-described corona discharge apparatus. A positive voltage is established on the photoreceptor 36 and on the first color-emitting phosphor material deposited thereon. The light exposure and phosphor development steps are repeated for each of the two remaining color-emitting phosphors producing the structures shown in FIGS. 4*c* and 4*d*. The repeat spacing d for a triad of phosphor lines is about 0.84–0.91 mm (0.033–0.036 in).

With reference to TABLES 3–5, the preferred sequence, according to the present invention, is to deposit the blue-emitting (B) phosphor first, then the red-(R), and finally the green-emitting (G) phosphors, because this sequence, as shown in TABLE 3, has the fewest misregister locations in both the standard lighthouse setting and an equal number of misregistered locations in the optimized setting. The blue-, green-, red-emitting phosphor sequence (B,G,R) shows a significant decrease in the number of misregistered locations with the optimized lighthouse setting; however, attempts to utilize this setting in a pilot production operation resulted in heavy piling of the last to be deposited red-emitting phosphor, and it is not being used.

The blue-, red-, green-emitting phosphor sequence (B,G, R) is the best for minimizing misregister because the layer voltages of the blue-emitting (29 V/mg/cm$^2$) and the red-emitting (20 V/mg/cm$^2$) phosphors can be counteracted by laterally offsetting the position of the light in the lighthouses using the optimum lighthouse parameters of B=–3.974 mm, R=+4.572 mm, and G=+0.254 mm. These optimum lighthouse settings require little lighthouse adjustment compared to the standard lighthouse settings. Finally, the B,R,G sequence deposits the green phosphor, which has the highest layer voltage (56 V/mg/cm$^2$), last, thereby eliminating the deleterious effect of its high layer voltage.

Other acceptable deposition sequences include R, G, B, which has the next fewest misregister locations for both the standard and optimized lighthouse alignments, and the R, B, G sequence in which the optimized alignment of the lighthouse provides as few misregister locations as the R, B, G sequence. The optimized lighthouse correction for the R, B, G sequence is R=+4.191 mm, B=–3.937 mm and G=+0.381 mm, whereas the optimum lighthouse correction for the R, G, B sequence is R=+4.191 mm, G=+0.381 mm and B=–3.683 mm.

The present invention demonstrates that misregister of the phosphor elements is primarily a function of the repulsive interaction between the subsequently deposited, triboelectrically charged phosphor particles and the previously deposited phosphor particles, which are electrostatically charged by the corona discharge device. However, misregister can be minimized by providing a lateral offset in the lighthouse so that the exposed areas on the photoreceptor for the second and third developments are displaced toward either the first deposited phosphor, or toward the prior deposited phosphor with the higher layer voltage so that the repulsive force of the deposited phosphor can be counteracted.

The three phosphors are fused to the OPC layer 34 of the photoreceptor 36 by contacting the materials with the vapor of a suitable solvent, in the manner described in U.S. Pat. No. 4,917,978, issued to Ritt et al. on Apr. 17, 1990. The screen structure is then spray-filmed and aluminized, as is known in the art, to form the luminescent screen assembly. The screen assembly is baked at a temperature of about 425° C. for about 30 minutes to drive off the volatilizable constituents of the screen assembly.

What is claimed is:

1. In a method of electrophotographically manufacturing a luminescent screen assembly on an interior surface of a faceplate panel for a color CRT having a photoreceptor on an interior surface thereof, comprising the steps of:

charging said photoreceptor to establish a substantially uniform electrostatic voltage thereon;

positioning said panel on an exposure device having a light source therein and exposing selected areas of said photoreceptor to visible light therefrom to affect the voltage thereon, without affecting the voltage on the unexposed area of said photoreceptor;

depositing a triboelectrically charged first color-emitting phosphor onto said exposed, selected areas of said photoreceptor;

recharging the unexposed area of said photoreceptor and said first color-emitting phosphor to reestablish an electrostatic voltage, the voltage on the unexposed area of said photoreceptor being different from the voltage on said first color-emitting phosphor; wherein the improvement comprises:

a) repositioning said panel on said exposure device, the location of said light source in said device being offset by an amount determined by the voltage difference between said photoreceptor and said first color-emitting phosphor, and exposing selected areas of said photoreceptor to visible light to affect the voltage thereon, while leaving the voltages on the unexposed area of said photoreceptor and said first color-emitting phosphor unaffected; and b) depositing a triboelectrically charged second color-emitting phosphor onto said exposed, selected areas of said photoreceptor.

2. The method as described in claim 1, further including the steps of:

c) recharging the unexposed area of said photoreceptor and said first and second color-emitting phosphors to reestablish an electrostatic voltage, the voltage on the unexposed area of said photoreceptor being different from the voltages on said first and second color-emitting phosphors;

d) repositioning said panel on said exposure device, the location of said light source in said device being offset by an amount determined by the voltage difference between said photoreceptor, said first and said second color-emitting phosphors, and exposing selected areas of said photoreceptor to visible light to affect the voltage thereon, while leaving the voltages on the unexposed area of said photoreceptor, said first and said second color-emitting phosphors unaffected; and e) depositing a triboelectrically charged third color-emitting phosphor onto said exposed, selected areas of said photoreceptor.

3. The method as described in claim 2, including the additional steps of:

(i) fusing said phosphors to said photoreceptor of said luminescent screen;

(ii) filming the fused screen;

(iii) aluminizing the filmed screen; and (iv) baking the aluminized screen to remove the volatilizable constituents therefrom to form said luminescent screen assembly.

4. In a method of electrophotographically manufacturing a luminescent screen assembly on an interior surface of a faceplate panel for a color CRT by depositing three triboelectrically charged, color-emitting phosphors onto a photoreceptor provided on said interior surface thereof, at least two of said phosphors having different surface charging properties that affect the deposition of subsequently deposited phosphors, comprising the steps of:

charging said photoreceptor to establish a substantially uniform electrostatic voltage thereon;

positioning said panel on an exposure device having a light source therein and exposing selected areas of said photoreceptor to visible light therefrom to create a charge image thereon by affecting the voltage on the exposed areas, without affecting the voltage on the unexposed area of said photoreceptor;

depositing a triboelectrically charged first color-emitting phosphor, by reversal development, onto said exposed, selected areas of said photoreceptor;

recharging the unexposed area of said photoreceptor and said first color-emitting phosphor to establish an electrostatic voltage, the voltage on the unexposed area of said photoreceptor being different from the voltage on said first color-emitting phosphor, because of the surface charging property of said phosphor; wherein the improvement comprises:

a) repositioning said panel on said exposure device, the location of said light source in said device being offset by an amount determined by the voltage difference between said photoreceptor and said first color-emitting phosphor, and exposing selected areas of said photoreceptor to visible light to affect the voltage thereon, while leaving the voltages on the unexposed area of said photoreceptor and said first color-emitting phosphor unaffected;

b) depositing a triboelectrically charged second color-emitting phosphor, by reversal development, onto said exposed, selected areas of said photoreceptor;

c) recharging the unexposed area of said photoreceptor and said first and second color-emitting phosphors to establish an electrostatic voltage, the voltage on the unexposed area of said photoreceptor being different from the voltages on said first and second color-emitting phosphors, because of the surface charging properties of said phosphors;

d) repositioning said panel on said exposure device, the location of said light source in said device being offset by an amount determined by the voltage difference between said photoreceptor, and said first and said second color-emitting phosphors, and exposing selected areas of said photoreceptor to visible light to affect the voltage thereon, while leaving the voltages on the unexposed area of said photoreceptor, said first and said second color-emitting phosphors unaffected; and e) depositing a triboelectrically charged third color-emitting phosphor, by reversal development, onto said exposed, selected areas of said photoreceptor to form a luminescent screen.

5. The method as described in claim 4, including the additional steps of:

(i) fusing said phosphors to said photoreceptor of said luminescent screen;

(ii) filming the fused screen;

(iii) aluminizing the filmed screen; and (iv) baking the aluminized screen to remove the volatilizable constituents therefrom to form said luminescent screen assembly.

* * * * *